US007114430B2

(12) United States Patent
Reedy et al.

(10) Patent No.: US 7,114,430 B2
(45) Date of Patent: Oct. 3, 2006

(54) ADAPTIVE POSITION DETERMINING SYSTEM FOR HYDRAULIC CYLINDER

(75) Inventors: John Thomas Reedy, Peoria, IL (US); Ramona Darlene Cone, Mackinaw, IL (US); Glen Robert Kloeppel, Chillicothe, IL (US); Srinivas Kowta, Peoria, IL (US); Jason Pagnotta, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 114 days.

(21) Appl. No.: 10/953,550

(22) Filed: Sep. 30, 2004

(65) Prior Publication Data

US 2006/0064971 A1 Mar. 30, 2006

(51) Int. Cl.
*F15B 13/16* (2006.01)

(52) U.S. Cl. ..... 91/392; 701/50; 702/105

(58) Field of Classification Search ..... 91/392, 91/419; 700/275, 254, 301, 302; 701/50; 702/105

See application file for complete search history.

(56) References Cited

U.S. PATENT DOCUMENTS 5,004,264 A 4/1991 Kozaki et al.
5,342,176 A 8/1994 Redlich
5,493,798 A * 2/1996 Rocke et al. ..... 701/50
5,496,153 A 3/1996 Redlich
5,710,514 A 1/1998 Crayton et al.
5,918,195 A * 6/1999 Halgrimson et al. ..... 701/50
5,987,371 A 11/1999 Bailey et al.
6,401,456 B1 * 6/2002 Moriya et al. ..... 60/433
6,484,620 B1 11/2002 Arshad et al.
6,549,873 B1 4/2003 Nagai
6,615,114 B1 * 9/2003 Skiba et al. ..... 702/105
6,722,261 B1 4/2004 Brown et al.
2001/0037689 A1 11/2001 Krouth et al.
2003/0084719 A1 5/2003 Wiklund et al.
2003/0106381 A1 6/2003 Krouth et al.

* cited by examiner

*Primary Examiner*—Thomas E. Lazo
(74) *Attorney, Agent, or Firm*—Finnegan, Henderson, Farabow, Garrett & Dunner

(57) ABSTRACT

A position determining system may include a hydraulic cylinder and a flow control device operatively connected to the hydraulic cylinder. A controller may be configured to supply an actuating signal to the flow control device. The controller may be configured to monitor a characteristic associated with the actuating signal, determine a hydraulic fluid flow rate in the hydraulic cylinder based on stored information relating the hydraulic fluid flow rate to the characteristic associated with the actuating signal, calculate a position of a component associated with the hydraulic cylinder based on the hydraulic fluid flow rate, and update the stored information when the determined position deviates from an actual position of the component.

25 Claims, 3 Drawing Sheets

ADAPTIVE POSITION DETERMINING SYSTEM FOR HYDRAULIC CYLINDER

TECHNICAL FIELD

The present disclosure is directed to a system for determining a position of a hydraulic cylinder component and, more particularly, to an adaptive system that uses feedback information to increase system accuracy in determining the position of a hydraulic cylinder component.

BACKGROUND

Various types of work machines may include one or more hydraulic cylinders for aiding in accomplishing a work function. These hydraulic cylinders are configured such that controlled flow of hydraulic fluid into one or more fluid reservoirs in the cylinder has the effect of retracting or extending a piston into or out of the cylinder. The movement of the piston may be used to move various work implements on the work machine. Hydraulic cylinders may be included on nearly any type of work machine such as, for example, track type tractors, wheeled tractors, shovel/excavators, dump trucks, garbage collection trucks, skid steers, etc.

For several reasons, it may be desirable to determine the position of the piston during operation of a hydraulic cylinder. For example, because the piston position may be operatively connected to a work implement, knowledge of the piston position may translate into knowledge of the position, orientation, or state of the work implement. This information may be used for setting motion limits on the work implement or for automating one or more functions of the work implement. Further, knowing the position of the piston in the cylinder may aid in controlling the operating conditions of the cylinder. For example, the operation of the cylinder may be smoothed by slowing the movement of the piston near its fully retracted or fully extended positions.

Several systems have been proposed for determining the position of a piston in a hydraulic cylinder. Many of these systems rely on information provided by one or more sensors associated with a hydraulic cylinder. For example, certain systems may include a position sensor to directly measure the position of the piston. Other systems predict the position of the piston based on information provided by pressure sensors that measure the pressure of the actuating hydraulic fluid in the cylinder. While these systems may be adequate for determining piston position, the addition of sensors can add significant cost and design complexity to the work machine.

Other systems have been contemplated that do not rely on the use of position and/or pressure sensors to determine the position of a piston in a hydraulic cylinder. For example, U.S. Pat. No. 5,004,264 to Kazaki et al. ("the '264 patent"), which issued on Apr. 2, 1991, describes a hydraulic system, used in an automotive suspension system, that includes a position control device to control the position of a piston in a hydraulic cylinder. The position control device functions by monitoring the magnitude of a control signal provided to a solenoid-operated fluid flow control valve. Using a predetermined relationship between the current of the control signal and flow rate in the hydraulic cylinder, the position control device calculates the position of the piston based on the magnitude of the current of the control signal and the period of time during which the current is supplied to the solenoid-operated valve.

While the system of the '264 patent may be able to determine the position of a piston in a hydraulic cylinder without the use of position and/or pressure sensors, the system of the '264 patent includes several shortcomings. For example, while the system of the '264 patent accounts for position prediction errors that can accumulate during operation of the hydraulic cylinder, the system uses this error information only to adjust the final position of the piston. The system of the '264 patent does not make use of this error information to adaptively adjust a position prediction algorithm. Thus, the system of the '264 patent is unable to dynamically model the performance of the positioning system to reduce or eliminate errors from the position calculation.

The present disclosure is directed to overcoming one or more of the problems of the prior art position control system.

SUMMARY OF THE INVENTION

One aspect of the present disclosure includes a position determining system. This system may include a hydraulic cylinder and a flow control device operatively connected to the hydraulic cylinder. A controller may be configured to supply an actuating signal to the flow control device. The controller may be configured to monitor a characteristic associated with the actuating signal, determine a hydraulic fluid flow rate in the hydraulic cylinder based on stored information relating the hydraulic fluid flow rate to the characteristic associated with the actuating signal, calculate a position of a component associated with the hydraulic cylinder based on the hydraulic fluid flow rate, and update the stored information when the determined position deviates from an actual position of the component.

Another aspect of the present disclosure includes a method of determining the position of a component associated with a hydraulic cylinder. The method may include monitoring a characteristic associated with a control signal supplied to a flow control device operatively connected to the hydraulic cylinder and determining a fluid flow rate in the hydraulic cylinder based on stored information relating the fluid flow rate to the characteristic associated with the control signal. A position of the component may be calculated based on the determined fluid flow rate. An error value corresponding to a difference between the calculated position and an actual position of the component may be determined, and this error value may be used to update the stored information.

Another aspect of the disclosure includes a work machine. The work machine may include a power source, a frame, and a work implement operatively connected to the frame. At least one hydraulic cylinder may be operatively connected to the frame and configured to assist in moving the work implement. A flow control device may be operatively connected to the hydraulic cylinder, and a controller may be configured to supply an actuating signal to the flow control device. The controller may be further configured to monitor a characteristic associated with the actuating signal, determine a hydraulic fluid flow rate in the hydraulic cylinder based on stored information relating the hydraulic fluid flow rate to the characteristic associated with the actuating signal, calculate a position of a component associated with the hydraulic cylinder based on the hydraulic fluid flow rate, and update the stored information when the determined position deviates from an actual position of the component.

DETAILED DESCRIPTION

Figure 1:
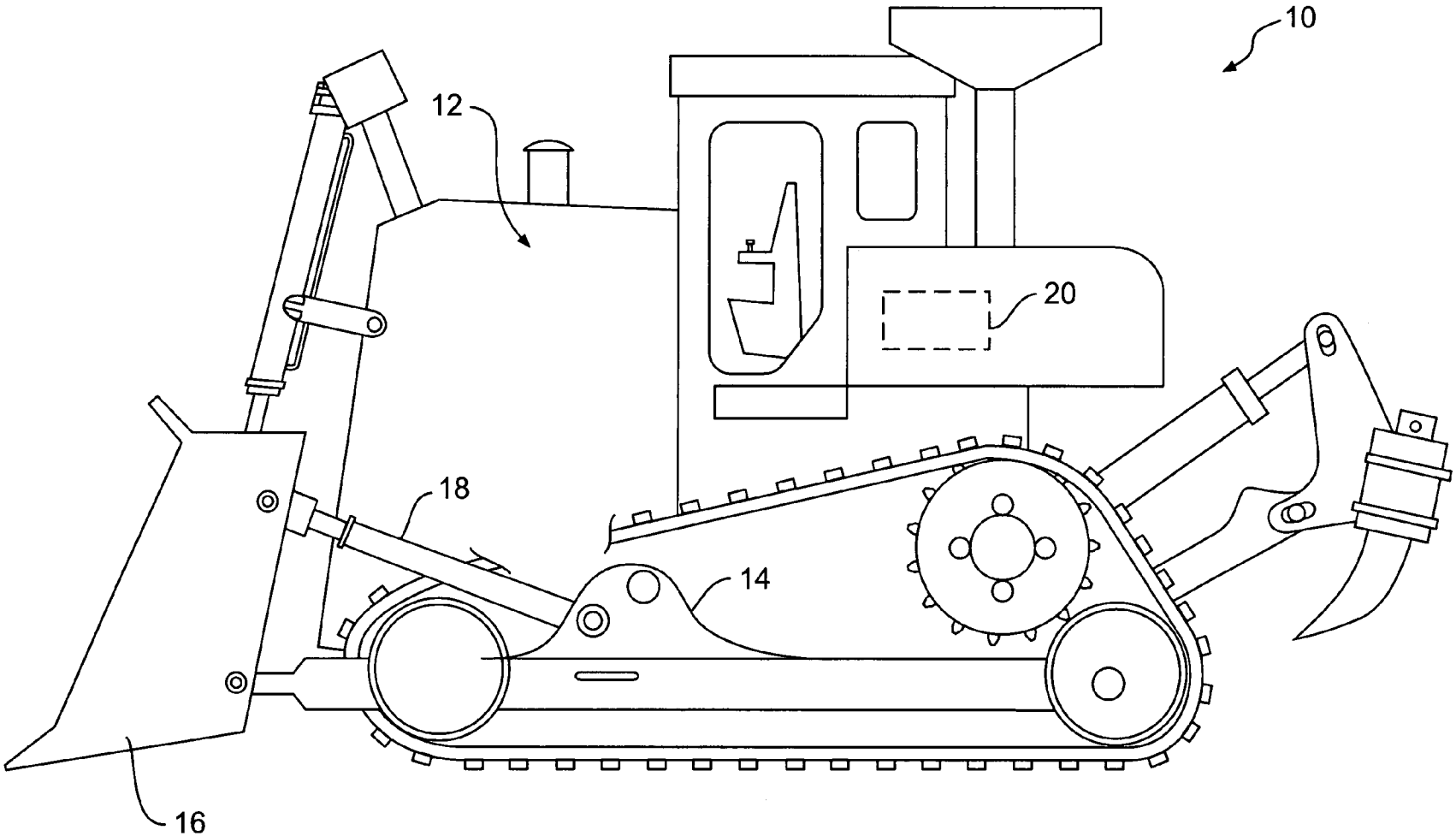
FIG. 1 is a pictorial illustration of a work machine according to an exemplary disclosed embodiment.

FIG. 1 provides a pictorial illustration of a work machine 10. While work machine 10 is shown as a track type tractor, work machine 10 may include various other types of machines. For example, work machine 10 may be a wheeled tractor, shovel/excavator, dump truck, garbage collection truck, skid steer, or any other type of machine or device that includes one or more hydraulic cylinders.

Work machine 10 may include a power source 12, a frame 14, and a work implement 16 operatively connected to frame 14. Work machine 10 may also include at least one hydraulic cylinder 18 operatively connected to frame 14 and configured to assist in moving or controlling work implement 16. A controller 20 may be included for electronically controlling the operation of hydraulic cylinder 18.

Work implement 16, while illustrated in FIG. 1 as a blade for a track type tractor, may constitute any type of device that can be controlled and/or moved using a hydraulic system. For example, work implement 16 may include a scraper, shovel, ripper, loading arm, bucket, pile driver, mower, and grappling device, or any other hydraulically controlled device.

Figure 2:
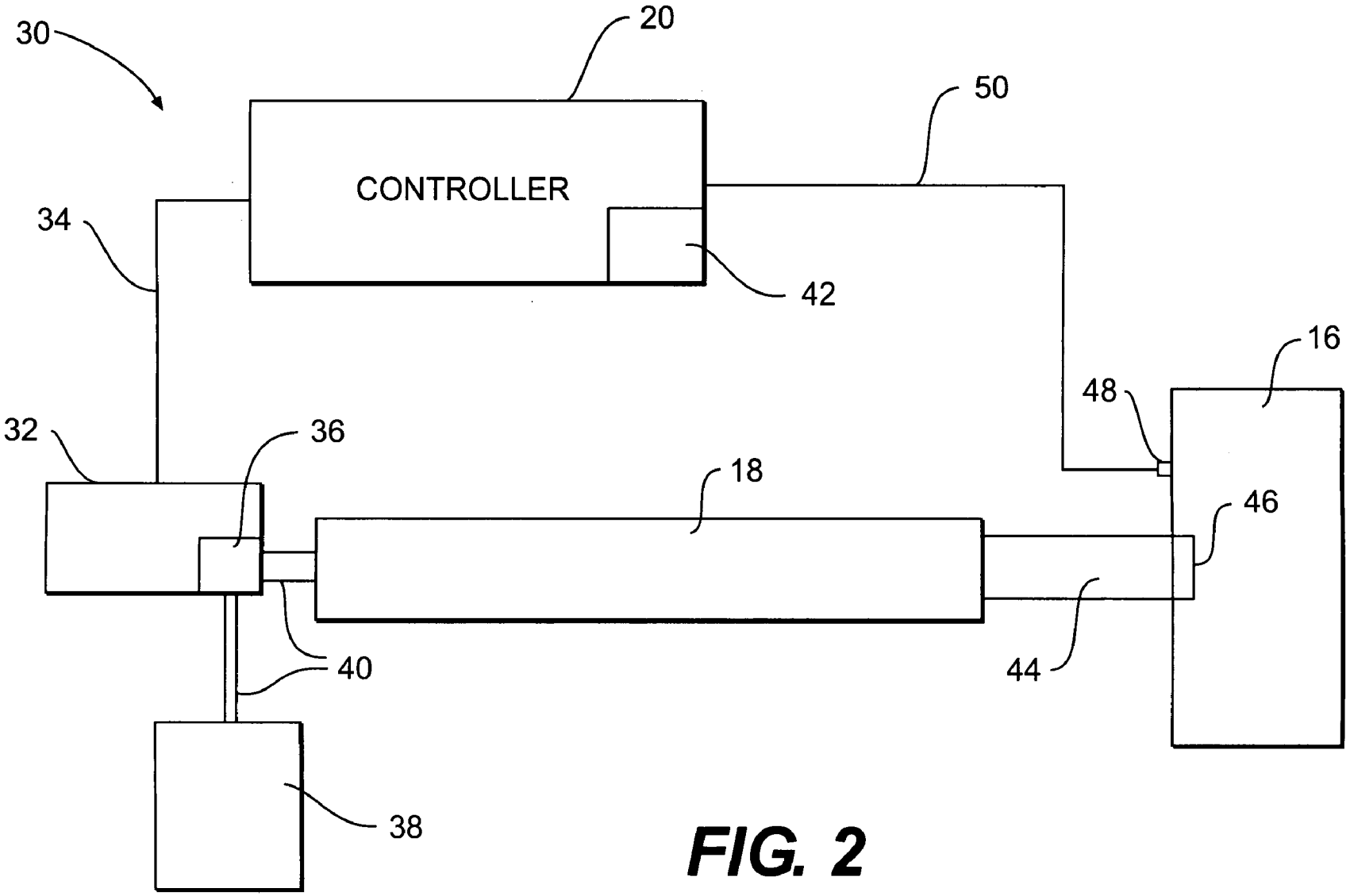
FIG. 2 is a block diagram representation of a hydraulic cylinder position determining system according to an exemplary disclosed embodiment.

FIG. 2 provides a block diagram representation of a position determining system 30 according to an exemplary disclosed embodiment. Position determining system 30 may include controller 20 to control the operation of a fluid actuator system 32 using control signals passed over communication line 34.

Controller 20 may include any devices suitable for running a software application. For example, controller 20 may include a CPU, RAM, one or more memory storage devices, I/O modules, etc. In one embodiment, controller 20 may constitute a unit dedicated for control and operation of the hydraulic systems of work machine 10. Alternately, however, controller 20 may be integrated with and/or correspond to an electronic control unit (ECU) of work machine 10.

Fluid actuator system 32 may include any components capable of controlling the flow of hydraulic fluid into and/or out of hydraulic cylinder 18. For example, fluid actuator system 32 may include various valves, pumps, conduits, and pilot pressure devices (not shown). In one embodiment, fluid actuator system 32 includes a flow control valve 36.

In response to a current signal supplied to fluid actuator system 32 by controller 20, flow control valve 36 may control the flow of hydraulic fluid between a hydraulic cylinder 18 and a fluid supply 38 via conduits 40. The current signal from controller 20 may be applied directly to flow control valve 36 to actuate a solenoid, for example, associated with flow control valve 36. Alternatively, the current signal supplied by controller 20 may be applied to one or more other devices or systems in fluid actuator system 32 and external to flow control valve 36 configured to control the operation of flow control valve 36.

Ultimately, the rate of fluid flow allowed by flow control valve 36 may be related to the magnitude of the current signal supplied by controller 20. This relationship may be calculated or empirically determined and stored in a memory 42, for example, as a current versus fluid flow rate map. During operation of system 30, controller 20 may access this stored information to determine the fluid flow rate into or out of hydraulic cylinder 18 that results from a control signal having a certain current magnitude.

The hydraulic fluid supplied to hydraulic cylinder 18 has the effect of moving a piston 44. Specifically, depending on the configuration of hydraulic cylinder 18, the flow of hydraulic fluid into hydraulic cylinder 18 may be used to extend piston 44 out of cylinder 18 and retract piston 44 into cylinder 18. Through a linkage 46, the motion of piston 44 can be translated to or used to control work implement 16, for example.

Position determining system 30 may be configured to determine the position of any moving component of hydraulic cylinder 18. In one embodiment, for example, position determining system 30 may be configured to determine the position of piston 44 with respect to hydraulic cylinder 18. Using the determined position of piston 44, especially in situations where there is a known relationship between the position of piston 44 and the position of work implement 16, controller 20 may be configured to determine a position of work implement 16 by translating from the determined position of piston 44.

Controller 20 can determine the position of a component of hydraulic cylinder 18 (e.g., piston 44) using the current to flow rate map stored, for example, in memory 42. Because controller 20 can generate the current signal supplied to fluid actuator system 32, controller 20 may be aware of the magnitude of the current signal and can be configured to monitor the magnitude of the current signal over time. In other systems where a component other than controller 20 generates the control signal, controller 20 may be configured to monitor the magnitude of the current signal generated by the other component. Controller 20 may access the current-flow rate lookup table in memory 42 to determine the hydraulic fluid flow rate that corresponds to the magnitude of the current signal. Based on known characteristics of hydraulic cylinder 18, including, for example, the surface area of piston 44 exposed to the hydraulic fluid, a velocity of piston 44 can be determined based on the fluid flow rate. To calculate a displacement of piston 44, this velocity can be integrated over a period of time during which the current signal is applied to fluid actuator system 32.

Position determining system 30 may also determine the presence of any errors in the calculated position of piston 44. For example, a switch 48 may be used to determine when hydraulic cylinder 18 has reached a fully retracted position (i.e., when piston 44 reaches its minimum displacement). Another optional switch (not shown) may be used to determine when hydraulic cylinder 18 has reached a fully extended position (i.e., when piston 44 reaches its maximum displacement). Switch 48 may communicate with controller 20 over communication line 50, for example. It should be noted that various other methods for determining when hydraulic cylinder 18 has reached a fully extended or fully retracted position may be used in alternative embodiments.

By determining when hydraulic cylinder 18 has reached a fully extended or a fully retracted position, there may be at least one point during the operation of hydraulic cylinder 18 where the actual position of piston 44 is known. Controller 20 may be configured to compare this actual, known position of piston 44 to the position calculated by integrating the velocity of piston 44. Controller 20 may be further configured to determine an error value corresponding to a difference between the actual, known position of piston 44 and the calculated position of piston 44.

Several factors may contribute to a non-zero error value. For example, changes in temperature may affect the viscosity of the hydraulic fluid. Such a change in viscosity may lead to lower than expected fluid flow rates for a particular current magnitude. Wear in the components of hydraulic cylinder 18 may also cause deviations from the stored current versus fluid flow rate map. Further, the initially stored map may, itself, contain inaccuracies that translate into errors in the calculated position of piston 44. If left unaccounted for, these errors could accumulate during each motion cycle of hydraulic cylinder 18 and render the calculated position of piston 44 unsuitable for certain applications.

Rather than simply adjusting the actual position of piston 44 or restarting the procedure of calculating the position of piston 44, neither of which would eliminate further errors in the calculated position of piston 44, the disclosed system includes an adaptive characteristic that can enable it to account for error causing factors and reduce or eliminate future errors from the calculation of the position of piston 44. For example, in response to a non-zero error value obtained by comparing the calculated position of piston 44 to the actual position (e.g., a fully extended or fully retracted stage of motion of hydraulic cylinder 18), controller 20 may generate an updated control current versus fluid flow rate map, including one or more modified values, that may aid in reducing or eliminating the error value. This updated map may be stored in memory 42 such that subsequent calculations to determine the position of piston 44, based on the updated map, may include less or even no error.

Controller 20 may be configured to calculate a position of piston 44, determine the presence of an error, and generate an updated map after any number of motion cycles of hydraulic cylinder 18. For example, an error value may be determined and an appropriate map may be generated after two, three, or more motion cycles. Alternately, controller 20 may be configured to determine an error value and generate an updated map for each motion cycle of hydraulic cylinder 18. In the case where two or more devices, such as switch 48, are present, an error value may be determined and an updated map may be generated multiple times for each motion cycle of hydraulic cylinder 18.

Controller 20 may also be configured to account for time delays that may occur during operation of hydraulic cylinder 18. For example, each time a new control signal is supplied to fluid actuator system 32, there may be a delay between the moment the control signal is issued and the time that piston 44 begins to move or changes its current motion state. If not accounted for, these time delays may accumulate and contribute to non-zero error values between the calculated position and actual position of piston 44. While it may be possible to at least partially account for the time delays in the updated maps generated by controller 20, these time delays may also be accounted for in the actual piston position calculation. For example, by monitoring the number of time delay-causing events, controller 20 may adjust the calculated piston position by an appropriate amount to compensate for the total number of time delayed events.

Figure 3:
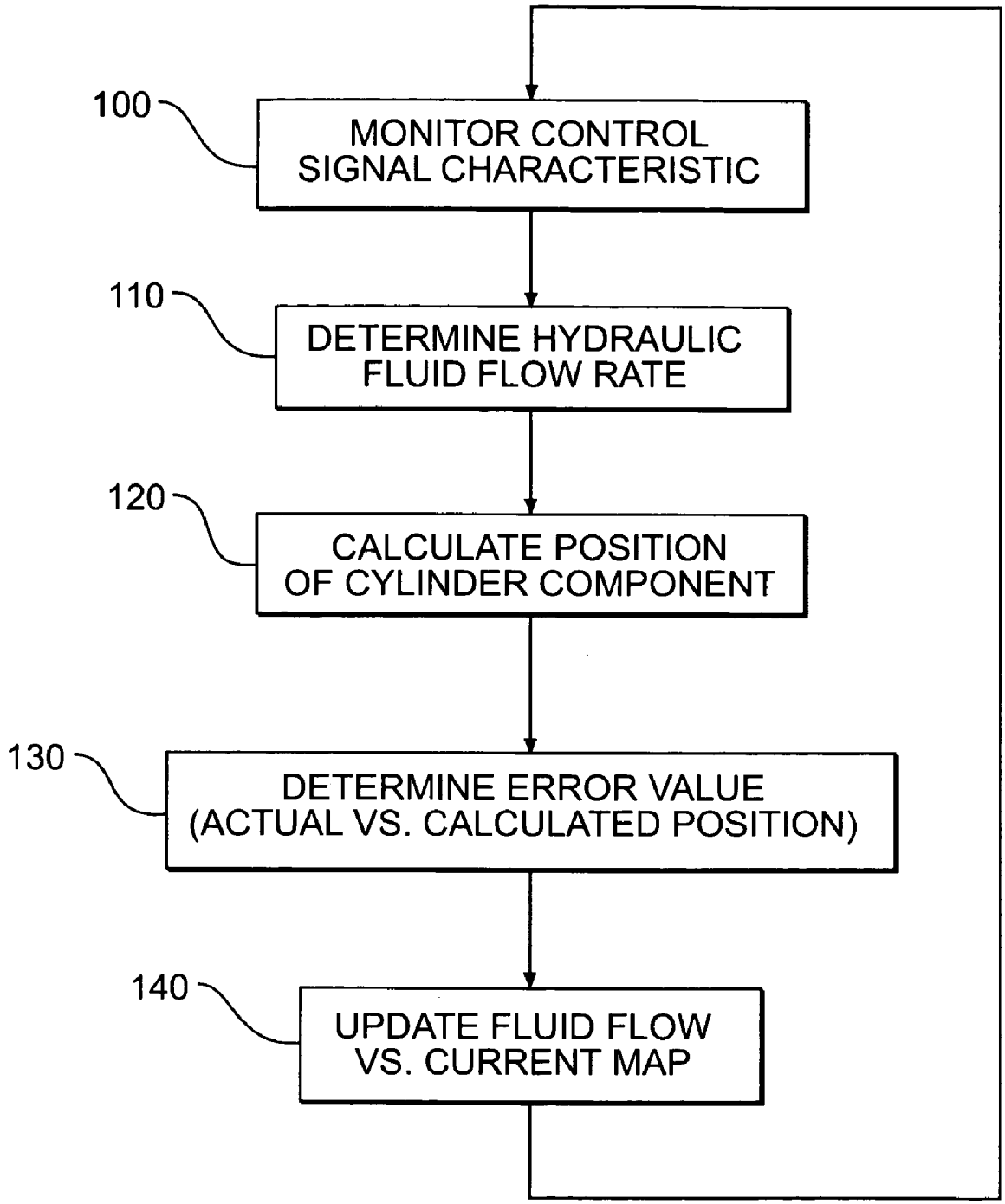
FIG. 3 is a flow chart illustrating the steps of an exemplary disclosed position determining method.

FIG. 3 provides a flow chart illustrating the steps of an exemplary disclosed position determining method. At step 100, controller 20 monitors a characteristic (e.g., current magnitude) associated with the control signal supplied to fluid actuator system 32. At step 110, controller 20 may determine a fluid flow rate in the hydraulic cylinder based on information, such as a current magnitude versus fluid flow rate map, stored in memory 42. At step 120, controller 20 may calculate a position of a component of hydraulic cylinder 18 (e.g., piston 44) based on the determined fluid flow rate. At step 130, controller 20 may determine an error value corresponding to a difference between the calculated position of the component and an actual position of the component. At step 140, controller 20 may update the fluid flow rate versus current magnitude map stored in memory 42 based on the error value.

INDUSTRIAL APPLICABILITY

The disclosed adaptive position determining system may be adapted for use with any hydraulic system. By not requiring dedicated position and/or pressure sensors to operate, the disclosed position determining system may offer a lower cost and more simply configured system compared to the position determining systems of the prior art. Further, the error correction capability of the present system can minimize or eliminate the effects of accumulating errors during the operation of a hydraulic cylinder. By observing these errors in a feedback type operation, the present system also has the ability to adapt to new operating environments or conditions by updating its own information maps to minimize or eliminate the reoccurrence of those errors.

The disclosed system may be included on various work machines for determining the position of work implements operatively connected to one or more hydraulic cylinders. For example, in one embodiment, the position determining system may be included on a track type tractor for determining the position of a hydraulically operated blade. The system may also be used for determining the position of various hydraulically operated components of a garbage collection vehicle. In one embodiment, the position determining system may be used to determine the position of a loading arm of a side-load garbage collection truck.

The disclosed position determining system may provide several functional benefits. In one embodiment, the system may be used to monitor the stage of extension of a hydraulic cylinder and to adjust the speed of extension or retraction during certain stages of operation. For example, the operation of a hydraulic cylinder may be slowed near the fully retracted and fully extended positions of the hydraulic cylinder to minimize wear and/or damage to the cylinder that may be caused when a piston of the cylinder slams against mechanical stops at the fully extended or retracted positions.

The disclosed system may also be used in a motion limiting operation for a work implement. Particularly, by determining the position of a component of a hydraulic cylinder and translating that position to a position of a work implement, a controller can determine whether a possible violation of a motion limit exists. In such a condition, the controller can electronically control the movement of the hydraulic cylinder, and therefore, the work implement, to operate only within predetermined motion limits.

In another embodiment, the position determining system may be used to enable an automatic positioning feature of a work implement. For instance, a controller may be configured to move the work implement to one or more predetermined locations and to use the disclosed position determining system to determine when the work implement reaches the desired predetermined location. In the case of a garbage collection vehicle, a controller may be configured to automatically return a trash bin to its original position and orientation after collecting the contents of the bin.

It will be apparent to those skilled in the art that various modifications and variations can be made in the disclosed position determining system without departing from the scope of the disclosure. Additionally, other embodiments of the disclosed system will be apparent to those skilled in the art from consideration of the specification. It is intended that the specification and examples be considered as exemplary only, with a true scope of the disclosure being indicated by the following claims and their equivalents.

The invention claimed is:

1. A position determining system, comprising:

a hydraulic cylinder;

a flow control device operatively connected to the hydraulic cylinder; and a controller configured to supply an actuating signal to the flow control device, wherein the controller is further configured to:

monitor a characteristic associated with the actuating signal, determine a hydraulic fluid flow rate in the hydraulic cylinder based on stored information relating the hydraulic fluid flow rate to the characteristic associated with the actuating signal, calculate a position of a component associated with the hydraulic cylinder based on the hydraulic fluid flow rate, and update the stored information when the determined position deviates from an actual position of the component.

2. The position determining system of claim 1, wherein the actuating signal is a current signal, the characteristic is a magnitude of the current signal, and the stored information is organized in a lookup table relating the magnitude of the current signal to the hydraulic fluid flow rate.

3. The position determining system of claim 1, further including a switch activated at a selected stage of a motion cycle of the hydraulic cylinder to determine the actual position of the component.

4. The position determining system of claim 3, wherein the selected stage corresponds to a fully extended or fully retracted position of the hydraulic cylinder.

5. The position determining system of claim 1, wherein the controller is configured to determine a difference between the calculated position of the component and the actual position of the component and update at least one value included in the stored information by an amount that at least partially accounts for the difference.

6. The position determining system of claim 1, wherein the controller is configured to update the stored information at least once for each motion cycle of the hydraulic cylinder.

7. The position determining system of claim 1, wherein the controller is configured to calculate the position of the component by determining a velocity of the component based on the hydraulic fluid flow rate and by integrating the velocity over a period of time.

8. The position determining system of claim 1, wherein the controller is configured to account for a time delay between the issuance of the actuating signal and an initial response of the hydraulic cylinder in calculating the position of the component.

9. A method of determining the position of a component associated with a hydraulic cylinder, comprising:

monitoring a characteristic associated with a control signal supplied to a flow control device operatively connected to the hydraulic cylinder;

determining a fluid flow rate in the hydraulic cylinder based on stored information relating the fluid flow rate to the characteristic associated with the control signal;

calculating a position of the component based on the determined fluid flow rate;

determining an error value corresponding to a difference between the calculated position and an actual position of the component; and updating the stored information based on the error value.

10. The method of claim 9, wherein the control signal is a current signal, and the stored information includes a lookup table relating fluid flow rate to a magnitude of the current signal.

11. The method of claim 9, further including using the calculated position to slow operation of the hydraulic cylinder as the hydraulic cylinder approaches a fully extended or a fully retracted position.

12. The method of claim 9, further including using a position indicator event to determine the actual position of the component.

13. The method of claim 12, wherein the position indicator event includes activating a switch when the hydraulic cylinder reaches a fully retracted or fully extended state.

14. The method of claim 9, wherein calculating the position of the component includes determining a velocity of the component based on the fluid flow rate and integrating the velocity to determine a displacement of the component.

15. The method of claim 9, wherein calculating a position of the component includes accounting for a time delay between initiation of the control signal and motion of the component.

16. A work machine, comprising:

a power source;

a frame;

a work implement operatively connected to the frame;

at least one hydraulic cylinder operatively connected to the frame and configured to assist in moving the work implement;

a flow control device operatively connected to the hydraulic cylinder; and a controller configured to supply an actuating signal to the flow control device, wherein the controller is further configured to:

monitor a characteristic associated with the actuating signal, determine a hydraulic fluid flow rate in the hydraulic cylinder based on stored information relating the hydraulic fluid flow rate to the characteristic associated with the actuating signal, calculate a position of a component associated with the hydraulic cylinder based on the hydraulic fluid flow rate, and update the stored information when the determined position deviates from an actual position of the component.

17. The work machine of claim 16, wherein the controller is configured to use the calculated position to return the work implement to a predetermined location.

18. The work machine of claim 16, wherein the controller is configured to restrict motion of the work implement based on the calculated position.

19. The work machine of claim 16, wherein the actuating signal is a current signal, the characteristic is a magnitude of the current signal, and the stored information is organized in a lookup table relating the magnitude of the current signal to the hydraulic fluid flow rate.

20. The work machine of claim 16, further including a switch activated at a selected stage of a motion cycle of the hydraulic cylinder to determine the actual position of the component.

21. The work machine of claim 20, wherein the selected position corresponds to a fully extended or fully retracted position of the hydraulic cylinder.

22. The work machine of claim 16, wherein the controller is configured to determine a difference between the calculated position of the component and the actual position of the component and update at least one value included in the stored information by an amount that at least partially accounts for the difference.

23. The work machine of claim 16, wherein the controller is configured to update the stored information at least once for each motion cycle of the hydraulic cylinder.

24. The work machine of claim 16, wherein the controller is configured to calculate the position of the component by determining a velocity of the component based on the hydraulic fluid flow rate and by integrating the velocity over a period of time.

25. The work machine of claim 16, wherein the controller is configured to account for a time delay between the issuance of the actuating signal and an initial response of the hydraulic cylinder in calculating the position of the component.

* * * * *